US008234057B2

(12) United States Patent
Shiraki et al.

(10) Patent No.: US 8,234,057 B2
(45) Date of Patent: Jul. 31, 2012

(54) INTER-VEHICLE COMMUNICATION APPARATUS AND INTER-VEHICLE COMMUNICATION METHOD

(75) Inventors: Hidenao Shiraki, Ogaki (JP); Tetsuya Nakamura, Chiryu (JP); Masaya Takatsuji, Kariya (JP)

(73) Assignee: Denso Corporation, Kariya (JP)

( * ) Notice: Subject to any disclaimer, the term of this patent is extended or adjusted under 35 U.S.C. 154(b) by 474 days.

(21) Appl. No.: 12/321,338

(22) Filed: Jan. 19, 2009

(65) Prior Publication Data

US 2009/0198440 A1 Aug. 6, 2009

(30) Foreign Application Priority Data

Feb. 4, 2008 (JP) ..... 2008-024094

(51) Int. Cl.
*G06G 7/76* (2006.01)
*G08G 1/056* (2006.01)

(52) U.S. Cl. ..... 701/117

(58) Field of Classification Search ..... 701/117, 701/118, 119; 340/933, 934, 935
See application file for complete search history.

(56) References Cited

U.S. PATENT DOCUMENTS 6,788,964 B1 * 9/2004 Satomura et al. ..... 455/575.9

FOREIGN PATENT DOCUMENTS

JP 2000-090395 3/2000

OTHER PUBLICATIONS

Document for Wireless Broadband Promotion Commitee, Japan Automobile Manufacurers Association, Inc. published Jul. 8, 2007 with partial translation, (23 pages).

* cited by examiner

*Primary Examiner* — Mark Beauchaine
(74) *Attorney, Agent, or Firm* — Harness, Dickey & Pierce, PLC

(57) ABSTRACT

An inter-vehicle communication apparatus mounted to a subject vehicle is disclosed. The apparatus includes: reception section receiving information about a peripheral vehicle from the peripheral vehicle; a detection section configured to identify the peripheral vehicle that satisfies a predetermined condition as a same directing peripheral vehicle based on the information about the peripheral vehicle; a determination section configured to determine whether the subject vehicle is one of a lead vehicle and a tail vehicle in a group of vehicles including the subject vehicle and the same directing peripheral vehicle; and a transmission control section configured to control the transmission section based on the determination by the determination section.

16 Claims, 6 Drawing Sheets

INTER-VEHICLE COMMUNICATION APPARATUS AND INTER-VEHICLE COMMUNICATION METHOD

CROSS REFERENCE TO RELATED APPLICATION

The present application is based on Japanese Patent Applications No. 2008-24094 filed on Feb. 4, 2008, the disclosure of which is incorporated herein by reference.

BACKGROUND OF THE INVENTION

1. Field of the Invention

The present invention relates to an inter-vehicle communication apparatus mounted to a vehicle to provide inter-vehicle commutation.

2. Description of Related Art

There is known an inter-vehicle communication apparatus mounted to a vehicle (i.e., subject vehicle) to provide inter-vehicle communication. The inter-vehicle communication is performed through transmitting information (e.g., positional information) about the subject vehicle to a vehicle existing around the subject vehicle, and through receiving information (e.g., positional information) about the vehicle existing around the subject vehicle. Hereinafter, the vehicle existing around the subject vehicle is also referred to as a peripheral vehicle.

JP-A-2000-90395 discloses an inter-vehicle communication apparatuses that transmits the information about the subject vehicle in a short cycle when the subject vehicle travels at a high speed, and in a long cycle when the subject vehicle travels at a low speed.

The inventors have clarified difficulties associated with the above inter-vehicle communication apparatus. The difficulties are described below, as a related art.

When one vehicle travels at a high speed and another vehicle travels at a low speed while the two vehicles are being approaching each other on a road, the inter-vehicle communication apparatus in the low-speed-traveling vehicle transmits the information in a long cycle. In the above case, the recognition of the presence of the low-speed traveling vehicle is delayed in the high-speed-traveling vehicle. The inter-vehicle communication apparatus thus cannot minimize, for example, a risk of the following accident; a subject vehicle approaches and collides with a tail vehicle of traffic-jammed vehicles that stop or travel at slow speeds due to some reasons.

When multiple vehicles travel at an approximately same high speed while forming a group, the inter-vehicle communication apparatus according to JP-A-2000-90395 has a short transmission cycle and increases communication traffic. It may thus become difficult for the apparatus in each vehicle of the group to transmit the information in a proper timing.

Referring to FIGS. 7A and 7B, the above-described points are explained below in more detail. A situation shown in FIG. 7A is such that: vehicles A, B and C are forming a group of vehicles while stopping or traveling at a low speed; and a vehicle D is approaching a tail vehicle of the group from behind the group. In the above situation, the apparatus according to JP-A-2000-90395 in each of the vehicles A, B, C is designed to have a long transmission cycle. Thus, the recognition of the presence of the vehicles A, B and C is delayed in the vehicle D. In a poor visibility condition, a risk of a probable collision cannot be eliminated.

A situation shown in FIG. 7B is such that: vehicles E to H are traveling on a same road at an approximately same speed in a same traveling direction while forming a group. When it is assumed that the vehicles E to H are traveling at a high speed (e.g., 60 km/h), the apparatus of JP-A-2000-90395 in each of the vehicles E to H has a short transmission cycle. Thus, communication traffic increases and it may become difficult for the apparatus in each vehicles E to H to transmit the information in a proper timing. The above difficulty becomes more notable as the number of vehicles in the group becomes larger.

SUMMARY OF THE INVENTION

In view of the above and other difficulties, it is an objective of the present invention to provide an inter-vehicle communication apparatus and an inter-vehicle communication method for efficient inter-vehicle communication.

According to a first aspect of the present invention, an inter-vehicle communication apparatus mounted to a subject vehicle is provided. The inter-vehicle communication apparatus includes: a transmission section configured to transmit information about the subject vehicle to a peripheral vehicle existing around the subject vehicle; a reception section configured to receive information about the peripheral vehicle from the peripheral vehicle; and a detection section configured to identify the peripheral vehicle that satisfies a predetermined condition as a same directing peripheral vehicle based on the information about the peripheral vehicle. The predetermined condition includes a first condition that the peripheral vehicle is traveling on a same road and in a same direction as the subject vehicle is traveling. The inter-vehicle communication apparatus further includes a determination section configured to determine whether the subject vehicle is one of a lead vehicle and a tail vehicle in a group of vehicles. The group of vehicles includes the subject vehicle and the same directing peripheral vehicle. The inter-vehicle communication apparatus further includes a transmission control section configured to control the transmission section in such manner that: (i) when the determination section determines that the subject vehicle is one of the lead vehicle and the tail vehicle in the group of vehicles, the transmission control section causes the transmission section to transmit the information about the subject vehicle in a first cycle; and (ii) when the determination section determines that the subject vehicle is neither the lead vehicle nor the tail vehicle in the group of vehicles, the transmission control section causes the transmission section to transmit the information about the subject vehicle in a second cycle. The first cycle is shorter than a predetermined cycle. The second cycle is longer than the predetermined cycle.

According to the above inter-vehicle communication apparatus, when the subject vehicle is one of the lead vehicle and the tail vehicle of the group of vehicles, the information is transmitted from the subject vehicle in a cycle shorter than a predetermined cycle. Thus, it become possible to, for example, notify at an early stage a presence of the one of the lead vehicle and the tail vehicle and a presence of the group of vehicles to another vehicle that is approaching the group. Also, it becomes possible to restrict a communication traffic increase in the group of vehicles since the inter-vehicle communication apparatus transmits the information in a cycle shorter than the predetermined cycle when the subject vehicle is neither the lead vehicle nor the tail vehicle of the group. The inter-vehicle communication apparatus provides inter-vehicle communication in an efficient manner.

According to a second aspect of the present invention, an inter-vehicle communication method for use in a subject vehicle to communicate with a peripheral vehicle existing around the subject vehicle is provided. The method includes: transmitting information about the subject vehicle to the peripheral vehicle by the transmission section; receiving information about the peripheral vehicle from the peripheral vehicle; and identifying the peripheral vehicle that satisfies a predetermined condition as a same directing peripheral vehicle based on the information about the peripheral vehicle. The predetermined condition includes a first condition that the peripheral vehicle is traveling on a same road and in a same direction as the subject vehicle is traveling. The method further includes: determining whether the subject vehicle is one of a lead vehicle and a tail vehicle in a group of vehicles. The group of vehicles includes the subject vehicle and the same directing peripheral vehicle. The method further includes: controlling the transmission section. The controlling includes: causing the transmission section to transmit the information about the subject vehicle in a first cycle when it is determined that the subject vehicle is one of the lead vehicle and the tail vehicle in the group of vehicles; and causing the transmission section to transmit the information about the subject vehicle in a second cycle when it is determined that the subject vehicle is neither the lead vehicle nor the tail vehicle in the group of vehicles. The second cycle is longer than the predetermined cycle. The first cycle is shorter than a predetermined cycle According to the above inter-vehicle communication method, when the subject vehicle is one of the lead vehicle and the tail vehicle of the group of vehicles, the information is transmitted from the subject vehicle in a cycle shorter than a predetermined cycle. Thus, for example, it becomes possible to notify at an early stage a presence of the one of the lead vehicle and the tail vehicle and a presence of the group of vehicles to another vehicle that is approaching the group. Also, it may become possible to restrict a communication traffic increase in the group of vehicles since the information is transmitted from the subject vehicle in a cycle shorter than the predetermined cycle when the subject vehicle is neither the lead vehicle nor the tail vehicle of the group. Inter-vehicle communication can be performed in an efficient manner.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EXEMPLARY EMBODIMENTS

Exemplary embodiments are described below with reference to the accompanying drawings.

(First Embodiment)

Figure 1:
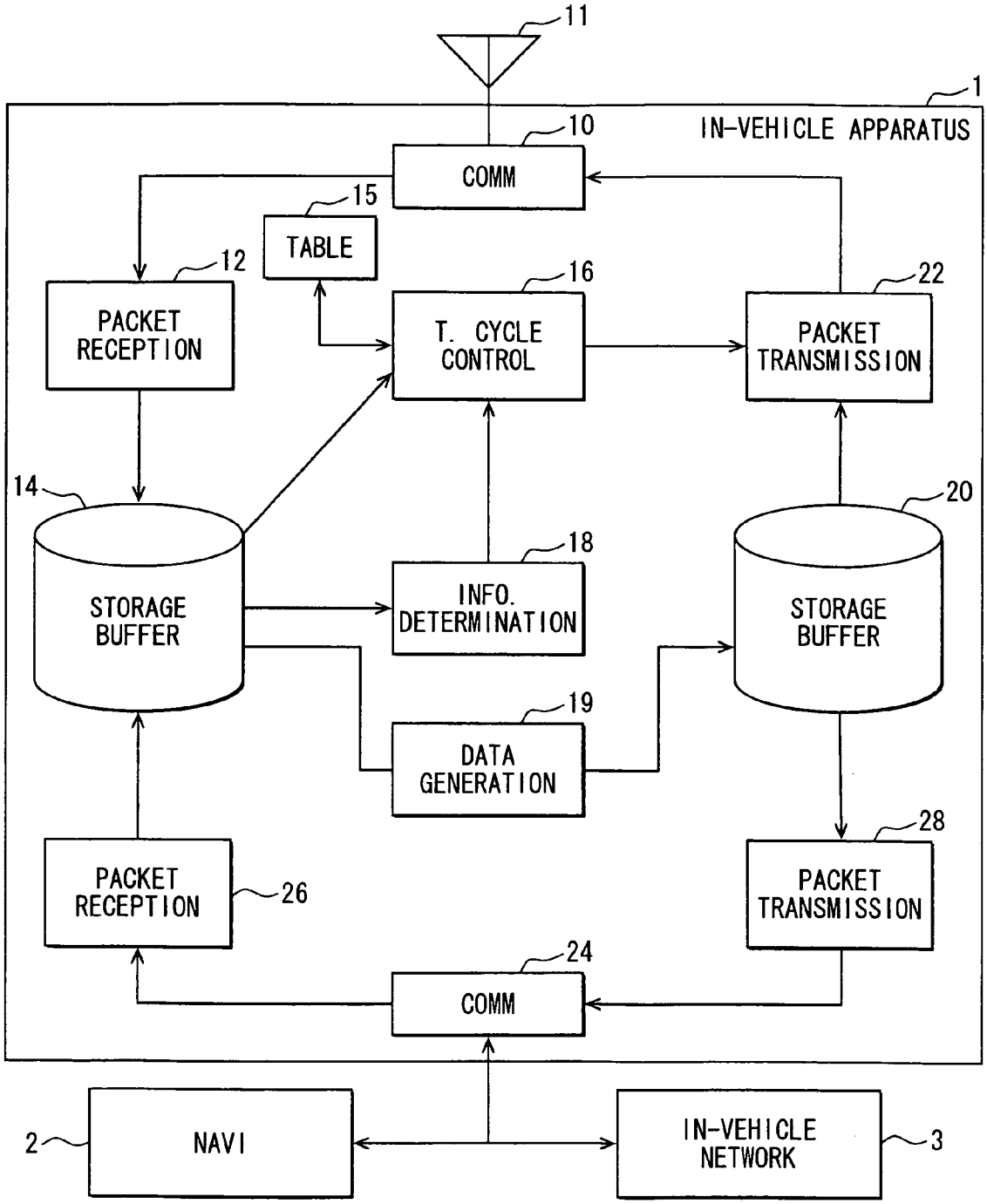
FIG. 1 is a block diagram illustrating an in-vehicle apparatus in accordance with the exemplary embodiments.

FIG. 1 is a block diagram illustrating an inter-vehicle communication apparatus 1 in accordance with the present embodiment. The inter-vehicle communication apparatus (i.e., an in-vehicle apparatus) 1 is mounted to a vehicle. The in-vehicle apparatus 1 includes a communication medium 10, an antenna 11, a packet reception unit 12, a packet reception storage buffer 14, a table 15, a transmission cycle control unit 16, an information determination unit 18, a data creation unit 19, a packet transmission storage buffer 20, a packet transmission unit 22, a communication medium 24, a packet reception unit 26, and a packet transmission unit 28.

Figure 2:
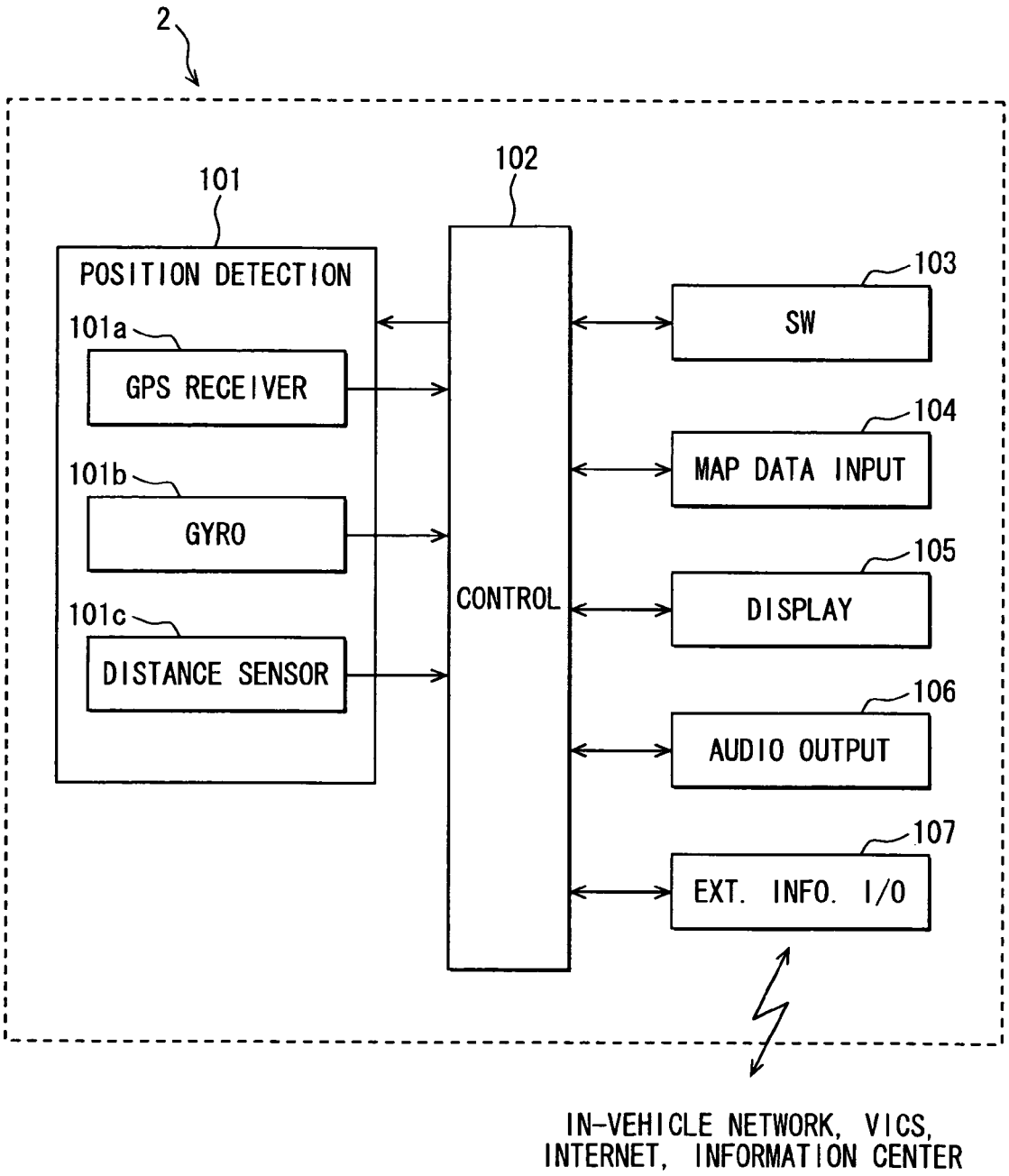
FIG. 2 is a block diagram illustrating a navigation system in accordance with the exemplary embodiments.

The in-vehicle apparatus 1 can be connected to an in-vehicle network 3, and can communicate with, for example, a navigation system 2. FIG. 2 is a block diagram illustrating a navigation system 2.

The navigation system 2 includes: a position detection unit 101 for detecting a present position of the subject vehicle; a control unit 102; an operation switch group 103 for use in inputting various instructions by, for example, a user, a driver or the like; a map data input unit 104 for inputting map data and various kinds of information from a external storage medium storing the map data and the various kinds of information; a display unit for providing various displays including a map display, a TV display; an audio output unit 106 for outputting an audio including various kinds of guidance audios; and an external information I/O unit 107. The control unit 102 exerts various processings in accordance with inputs from the position detection unit 101, the operation switch group 103, the map data input unit 104, and the external information I/O unit 107. The control unit 102 can control the position detection unit 101, the operation switch group 103, the map data input unit 104, the display unit 105, the audio output unit 106, and the external information I/O unit 107.

The position detection unit 101 includes a GPS (Global Positioning system) receiver 101*a*, a gyroscope 101*b* and a distance sensor 101*c*. The GPS receiver 101*a* receives, via a GPS antenna, electromagnetic waves transmitted from satellites for GPS to detect a position, an orientation, a speed of the subject vehicle. The gyroscope 101*b* detects a rotation of the subject vehicle. The distance sensor 101*c* detects a travel distance of the subject vehicle based on an acceleration along a forward-backward direction. Since the GPS receiver 101*a*, the gyroscope 101*b* and the distance sensor 101*c* has different types of detection errors, the GPS receiver 101*a*, the gyroscope 101*b* and the distance sensor 101*c* are used while the detection errors are mutually being compensated.

The operation switch group 103 includes, for example, a mechanical switch arranged in a periphery of the display unit 105 and a switch item displayed on a screen of the display unit 105. A touch-sensitive panel integrated with the screen of the display unit 105 allows operation of the switch item displayed on the screen. The touch-sensitive panel and the screen of the display unit may be integrally laminated. The touch-sensitive panel may be a pressure-sensitive type, an electromagnetic induction type, a capacitive sensing type, or the like. Alternatively, the touch-sensitive panel may be combination of the above and other types.

The map data input unit 104 is used for inputting a map data stored in a storage medium (not shown). The map data includes the followings: a link data having road information; a node data having intersection information; a data for map-matching for improvement of positioning accuracy; a mark data having facility information; an image data for guidance; and an audio data. Various kinds of storage medium can be employed as a storage medium for storing the above data. For example, a CD-ROM, a DVD, a hard disk, many types of memory cards or the like can be employed.

The display unit 105 can provides a color display. The display unit 105 includes, for example, a LCD display, a plasma display, a CRT display or the like. The display unit 105 can display multiple information items on the screen while the information items being overlapping between each other. The multiple information items include those for a map and a mark on the map representing a present position of the subject vehicle. The mark on the map is displayed based on (i) the map data input from the map data input unit 104 and (ii) the present position of the subject vehicle detected with the position detection unit 101. The multiple information items further includes those for a navigation route to a destination, a name, a landmark, a mark for facility guidance, or the like.

The audio output unit 106 can output sounds representing various types of guidance input from the map data input unit 104. The various types of guidance include facility guidance. The audio output unit 106 can further output a read aloud sound representing information obtained via the external information I/O unit 107.

The external information I/O unit 107 transmits and receives information through the in-vehicle network 3. In addition, the external information I/O unit 107 receives a FM broadcasting signal through a radio antenna (not shown), or receives a radio beacon signal or an infrared beacon signal transmitted from a fixed station that is arranged nearby a road. Through the fixed station, service of a VICS (Vehicle information and Commutation System) may be provided. For processing, the received information is sent to the control unit 102. The external information I/O unit 107 can also provide internet connection.

The control unit 102 includes a known microcomputer having a CPU, a ROM, a RAM, an I/O, and a bus line for connecting the foregoing components and the like. Using a program stored in the ROM or the like, the control unit 102 calculates a present position of the subject vehicle as a group of a coordinate, a heading direction of the subject vehicle and the like, based on detection signals from the position detection unit 101. The control unit 102 causes the display unit 105 to display a map around the present position of the subject vehicle. The map is read via the map data input unit 104. Based on a point data stored in the map data input unit 104, the control unit 102 performs a route calculation to automatically obtain an optimum route from the present position to a destination. The destination may be selected through operation of the operation switch group 103.

Turning back to FIG. 1, the in-vehicle apparatus 1 receives various types of information from the navigation system 2 via the communication medium 24. The various types of information include those for the present position, the orientation and the speed of the subject vehicle in addition to the map around the present position of the subject vehicle. The in-vehicle apparatus 1 can further receive information from the in-vehicle network 3. The information received from the navigation system 2 and the in-vehicle network 3 via the communication medium 24 is referred to hereinafter as subject vehicle information. The in-vehicle apparatus 1 receives the subject vehicle information cyclically or regularly.

The subject vehicle information received via the communication medium 24 is sent to a packet reception unit 26. The subject vehicle information may be formatted in, for example, packet. The packet reception unit 26 writes the subject vehicle information into the packet reception storage buffer 14. Thereby, the subject vehicle information received from the navigation system 2 is accumulated in the packet reception storage buffer 14.

The in-vehicle apparatus 1 receives information about a peripheral vehicle from the peripheral vehicle in a wireless manner via the antenna 11 and the communication medium 10. The information is formatted in, for example, packet. The information received with the antenna 11 is sent to the communication medium 10. The information about a peripheral vehicle includes information indicating a present position, an orientation and a speed of the peripheral vehicle. The information about a peripheral vehicle received from the peripheral vehicle is referred to hereinafter as peripheral vehicle information.

The peripheral vehicle information received via the antenna 11 and the communication medium 10 is sent to the packet reception unit 12. The packet reception unit 12 writes the peripheral vehicle information into the packet reception storage buffer 14. Thereby, the peripheral vehicle information received from the peripheral vehicle is accumulated in the packet reception storage buffer 14.

The data creation unit 19 creates information (i.e., data) about the subject vehicle, which data is to be sent toward the peripheral vehicle, based on the subject vehicle information accumulated in the packet reception storage buffer 14. The data creation unit 19 writes the created information into the packet transmission storage buffer 20. Based on the peripheral vehicle information accumulated in the packet reception storage buffer 14, the data creation unit 19 also creates another type of information (i.e., data) about the peripheral vehicle, which data is to be sent to the navigation system 2 or the in-vehicle network 3 of the subject vehicle. The data creation unit 19 writes the created another type of information into the packet transmission storage buffer 20.

Among the information about the peripheral vehicle (which information includes the data to be sent to the navigation system 2 or the in-vehicle network 3 and is accumulated in the packet transmission storage buffer 20), the packet transmission unit 28 reads predetermined information and transmits the read predetermined information via the communication medium 24 to the navigation system 2 or the in-vehicle network 3.

The packet transmission unit 22 reads the information about the subject vehicle accumulated in the packet transmission storage buffer 20. The packet transmission unit 22 transmits the read information about the subject vehicle data via the communication medium 10 and the antenna 11 toward the peripheral vehicle in a wireless manner.

The transmission cycle control unit 16 controls a transmission cycle of the packet transmission unit 22. More specifically, the transmission cycle control unit 16 reads information about a subject vehicle speed among the information stored in the packet reception storage buffer 14, and calculates the transmission cycle based on the speed of the subject vehicle. For example, the calculation is performed with reference to table information in the table 15. The use of table information can allow unique determination of the transmission cycle based on the speed of the subject vehicle. According to the table information, the transmission cycle becomes shorter as the speed of the subject vehicle becomes larger.

The transmission cycle control unit 16 outputs to the packet transmission unit 22 an instruction indicating that information should be transmitted in a calculated cycle. The packet transmission unit 22 transmits the subject vehicle information toward the peripheral vehicle in a cycle indicated by the transmission cycle control unit 16.

The information determination unit 18 regularly or cyclically performs a transmission cycle adjustment procedure, which is described below with reference to FIG. 3. In the present embodiment, the transmission cycle can vary in a range, for example, between 100 μsec and 2000 μsec.

At S110, information indicating a subject vehicle approach (which information is referred to hereinafter as subject vehicle approach intersection information) is acquired based on the subject vehicle information accumulated in the packet reception storage buffer 14. The subject vehicle approach intersection is one that is positioned nearest to the subject vehicle among intersections existing in the traveling direction of the subject vehicle.

At S120, the peripheral vehicle information is acquired from among information accumulated in the packet reception storage buffer 14. As described above, the peripheral vehicle information is received over inter-vehicle communication in a wireless manner and is accumulated in the packet reception storage buffer 14.

At S130, information indicating a peripheral vehicle approach intersection (which information is referred to hereinafter as peripheral vehicle approach intersection information) is acquired based on the peripheral vehicle information acquired at S120. The peripheral vehicle approach intersection is one that is positioned nearest to the peripheral vehicle among intersections existing in the traveling direction of the peripheral vehicle. In the above process, the in-vehicle apparatus 1 acquires or receives map information indicating a map around the present position of the peripheral vehicle. The in-vehicle apparatus 1 acquires or receives the map information from, for example the navigation system 2 by communicating with the navigation system 2. Then, the information determination unit 18 acquires the peripheral vehicle approach intersection information based on the map information. Alternatively, the navigation system 2 may transmit the peripheral vehicle approach intersection information itself to the in-vehicle apparatus 1.

At S140, a group of vehicles including the subject vehicle and the peripheral vehicle is recognized or set if the peripheral vehicle is determined to satisfy the following condition: the peripheral vehicle approach intersection is identical to the subject vehicle approach intersection. The peripheral vehicle that satisfies the above-described condition is referred to hereinafter as a same directing peripheral vehicle. In the above, the subject vehicle and the same directing peripheral vehicle are assumed to be traveling on a same road and a same direction relative to the same road. According to the manners, the same directing peripheral vehicle is recognized as or set to a member of the group of vehicles that the subject vehicle belongs to.

At S150, it is determined whether the subject vehicle is one of a lead vehicle and a tail vehicle in the group recognized or set at S140. When it is determined at S150 that the subject vehicle is one of the lead vehicle and the tail vehicle in the group, corresponding to YES at S150, process proceeds to S160.

At S160, it is determined whether the speed of the subject vehicle is larger than a predetermined speed. When it is determined that the speed of the subject vehicle is larger than the predetermined speed, corresponding to YES at S160, process proceeds to S170. At S170, an instruction indicating that the transmission cycle is not changed is issued and output to the transmission cycle control unit 16. Thus, content of a transmission instruction from the transmission cycle control unit 16 to the packet transmission unit 22 is not changed. That is, the transmission cycle in the packet transmission unit 22 remains a cycle that is determined from the speed of the subject vehicle. After S170, the transmission cycle adjustment procedure is ended.

When it is determined at S160 that the speed of the subject vehicle is not larger than the predetermined speed, that is, the speed of the subject vehicle is smaller than or equal to the predetermined speed, corresponding to NO at S160, process proceeds to S180. At S180, an instruction indicating that the transmission cycle should be changed is issued and output to the transmission cycle control unit 16. More specifically, the instruction is issued indicating that the transmission cycle should be changed into a cycle for a case where the speed of the subject vehicle is larger than the predetermined speed. The above change is made in order to shorten the cycle of the information transmission in view of a situation where the subject vehicle is one of the lead vehicle and the tail vehicle in the group of vehicles. After S180, the transmission cycle adjustment procedure is ended.

When it is determined at S150 that the subject vehicle is neither the lead vehicle nor the tail vehicle, corresponding to NO at S150, process proceeds to S190. At S190, it is determined whether the speed of the subject vehicle is less than or equal to the predetermined speed. When it is determined that the speed of the subject vehicle is less than or equal to the predetermined speed, corresponding to YES at 190, process proceeds to S195. At S195, an instruction indicating that the transmission cycle should not be changed is issued and output to the transmission cycle control unit 16. After S195, the transmission cycle adjustment procedure is ended.

When it is determined at S190 that the speed of the subject vehicle is not less than or equal to the predetermined speed, that is, larger than the predetermined speed, corresponding to NO at S190, process proceeds to S200. At S200, an instruction indicating that the transmission cycle should be changed is issued and output to the transmission cycle control unit 16. More specifically, an instruction is issued indicating that the transmission cycle should be changed into a cycle for a case where the speed of the subject vehicle is less than or equal to the predetermined speed. The above change is made in order to lengthen the information transmission cycle in view of a situation where the subject vehicle is neither the lead vehicle nor the tail vehicle in the group of vehicles. After S200, the transmission cycle adjustment procedure is ended.

Figure 4:
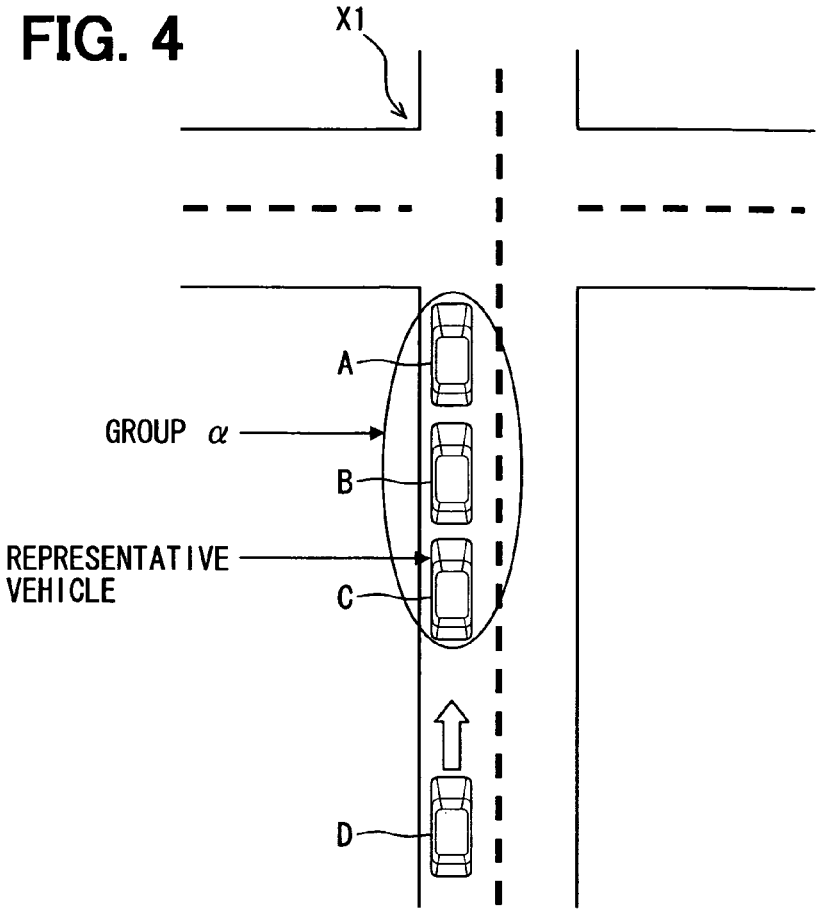
FIG. 4 is a diagram for use in explaining advantages of the exemplary embodiments.
Figure 5A:
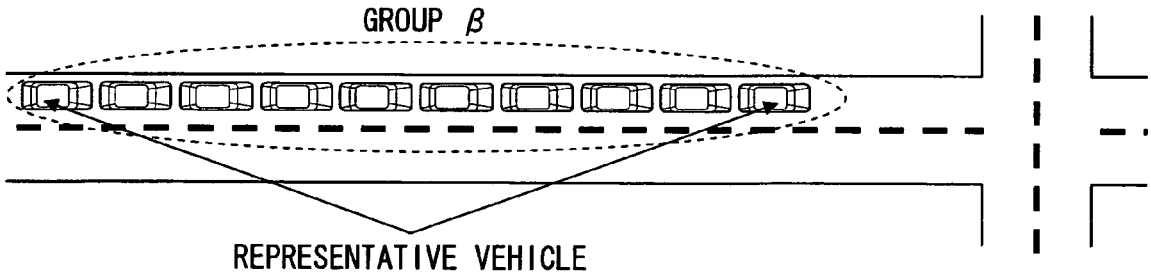
FIGS. 5A and 5B are diagrams for use in explaining advantages of the exemplary embodiments.
Figure 5B:
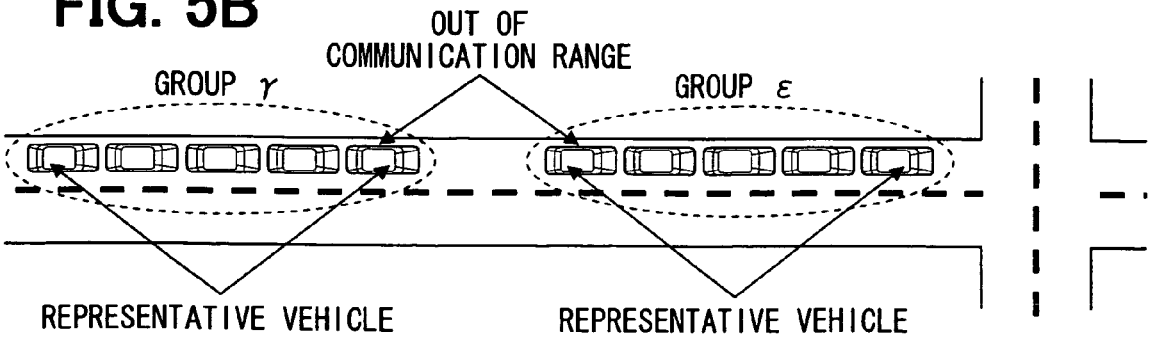

FIGS. 4, 5A and 5B are diagrams for use in explaining advantages of a first embodiment. A situation shown in FIG. 4 is as follows. Vehicles A, B and C are forming a group "α" of vehicles and are approaching an intersection X1 at a low speed. A vehicle D is approaching the group "α" at a high speed from behind the group "α". It is also assumed that the vehicle C and the vehicle D are traveling out of the range of communication with each other.

In the above situation, since no peripheral vehicle exists in the communication range of the vehicle D, the vehicle D does not belong to the group "α" of vehicles. Further, the in-vehicle apparatus 1 of the vehicle D transmits information in the cycle with a value that is calculated according to the speed.

The in-vehicle apparatus 1 of each of the vehicles A, B and C acquires, in a manner corresponding to S110, subject vehicle approach intersection information that indicates the intersection X1. Further, the in-vehicle apparatus 1 of each of the vehicles A, B and C acquires, corresponding to S120 and S130, peripheral vehicle approach intersection information that indicates the intersection X1. The in-vehicle apparatus 1 of each of the vehicles A, B and C recognizes, corresponding to S140, a group of vehicles that includes the subject vehicle and the peripheral vehicles. In this case, the recognized group is the group "α" of vehicles, each in-vehicle apparatus 1 in which recognizes that the intersection indicated by the peripheral vehicle approach intersection information is identical to that indicated by the subject vehicle approach intersection information.

The in-vehicle apparatus 1 of each of the vehicles A and C determines that the subject vehicle (i.e., the each of the vehicles A and C) is the lead vehicle or the tail vehicle in the group. The above determination corresponds to YES at S150. In the in-vehicle apparatus 1 of the each of the vehicles A and C, the transmission cycle is changed into a shorter one, according to manners corresponding to NO at S160 and S190. The in-vehicle apparatus 1 of the vehicle B determines that the subject vehicle (i.e., the vehicle B) is neither the lead vehicle nor the tail vehicle in the group. The above determination corresponds to NO at S150. In the in-vehicle apparatus 1 of the vehicle B, the transmission cycle is not changed. This process corresponds to YES at S190 and S195.

In FIG. 4, a representative vehicle refers to one of a lead vehicle and a tail vehicle in the group (see also FIG. 5A). The vehicle C corresponds to the tail vehicle of the group "α", that is, the vehicle C is the representative vehicle in an example shown in FIG. 4. The vehicle A also corresponds to the representative vehicle.

In the in-vehicle apparatus 1 of each representative vehicle, as described above, the transmission cycle is changed into a shorter one, or remains un-changed if the transmission cycle has already been set to the shorter one. Therefore, the vehicle D, which is approaching the group "α" of vehicles from behind the group "α", can recognizes the presence of the tail vehicle (i.e., the vehicle C; the representative vehicle) of the group "α" in an early stage. According to the above manners, it is possible to reduce a risk of collision of the vehicle D with the vehicle C (i.e., the group "α").

In the in-vehicle apparatus 1 of the vehicle B, which is not the representative vehicle, the transmission cycle is changed into a longer one, or remains un-changed if the transmission cycle has already been set to the longer one. According to the above manners, it is possible to restrict a communication traffic increase in the group "α" of vehicles. Thus, it becomes possible to properly perform inter-vehicle communication between the vehicles A, B and C.

In the present embodiment, a group of vehicle is formed by vehicles that travel in a region where the vehicles are capable of communicating with each other. For example, as shown in FIG. 5B, a representative vehicle (i.e., a lead vehicle) in a group "γ" and a representative vehicle (a tail vehicle) in a group "ε" are traveling out of the range of communication with each other. In the above case, the above-described representative vehicles belong to different groups, or in other words, do not belong to a same group.

(Second Embodiment)

Figure 3:
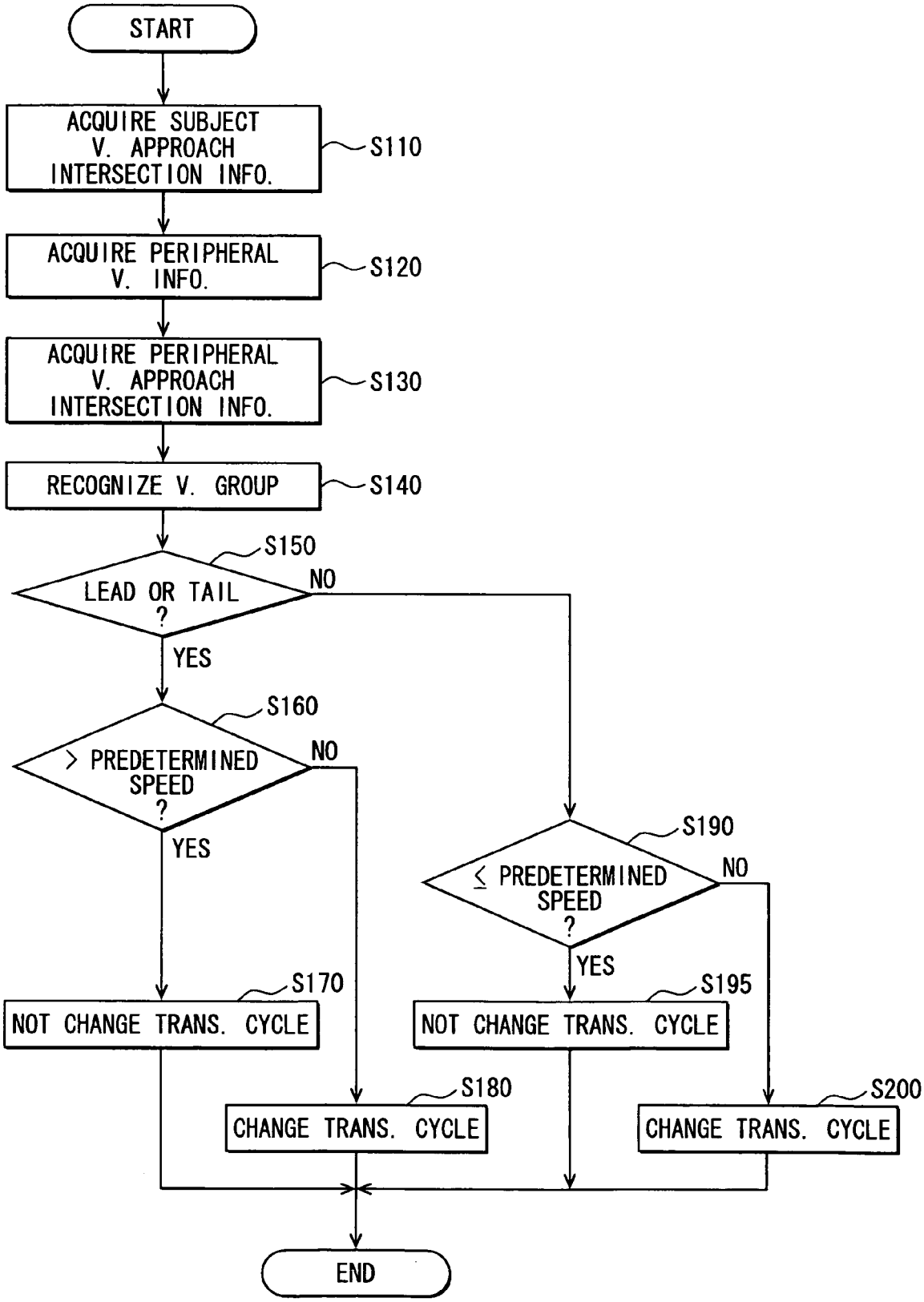
FIG. 3 is a flow chart illustrating a transmission cycle adjustment procedure in accordance with a first embodiment.
Figure 6:
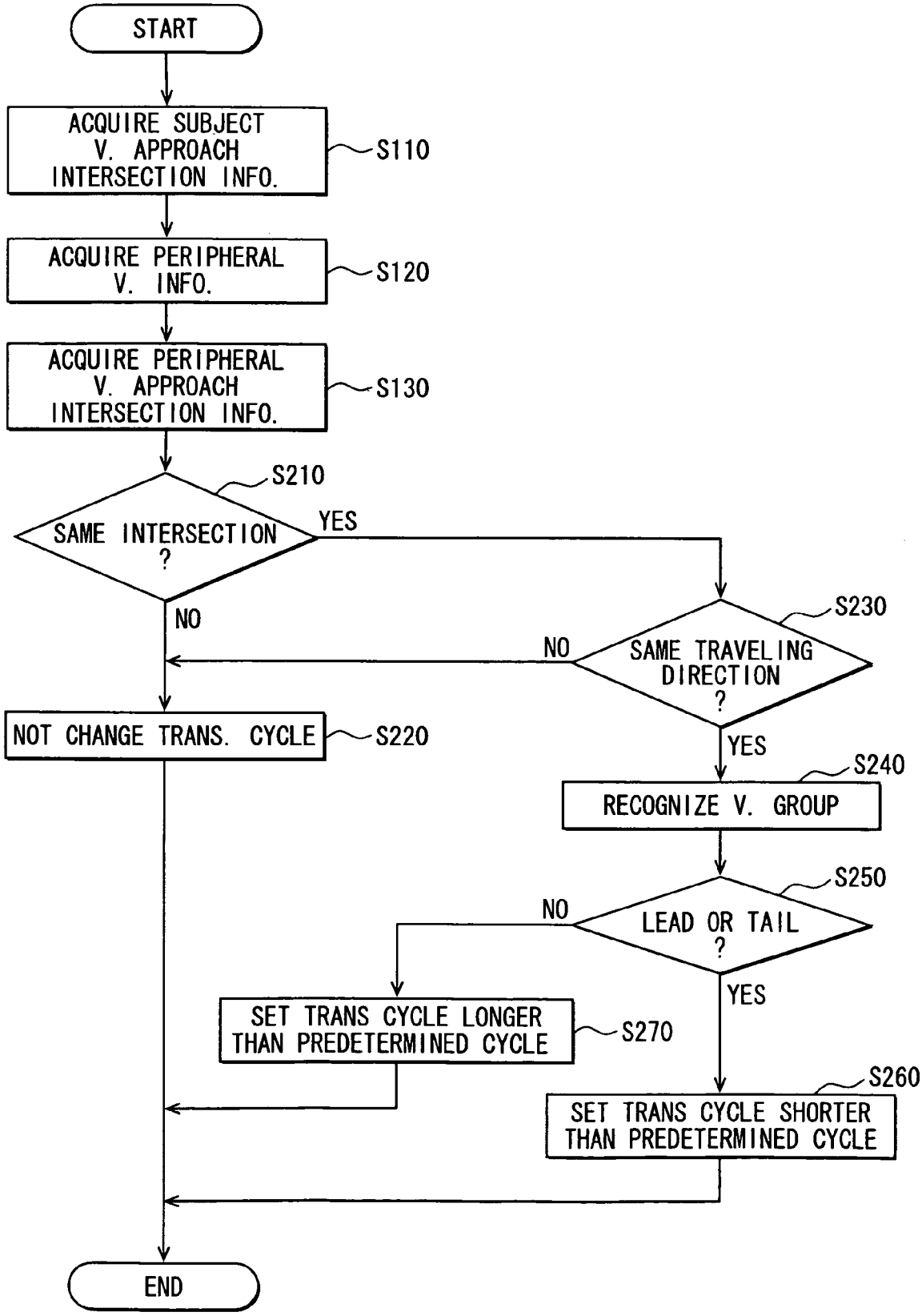
FIG. 6 is a flow chart illustrating a transmission cycle adjustment procedure in accordance with a second embodiment.
Figure 7A:
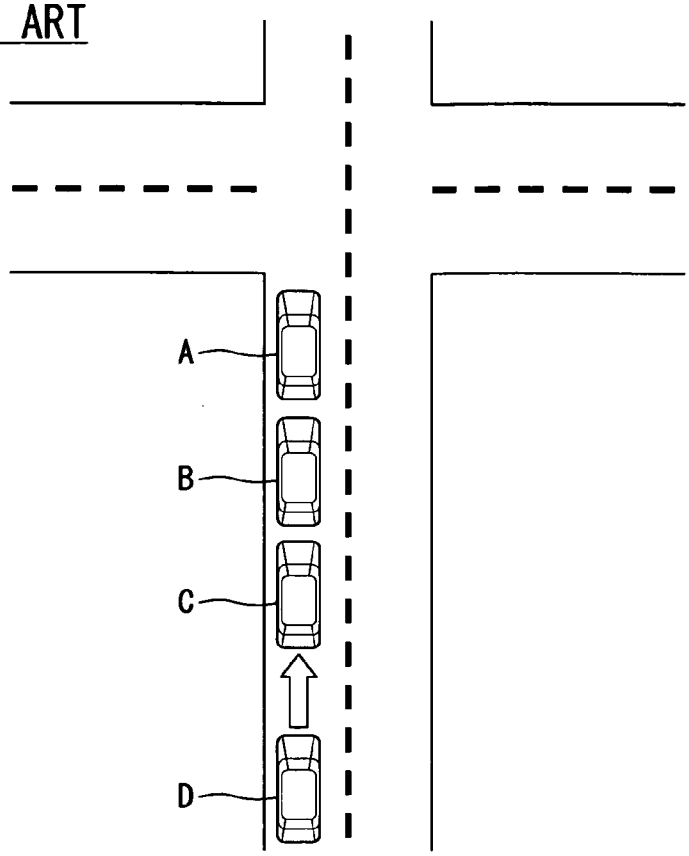
FIG. 7A RELATED ART
FIGS. 7A and 7B are diagrams for use in explaining disadvantages of a conventional apparatus as a related art.
Figure 7B:
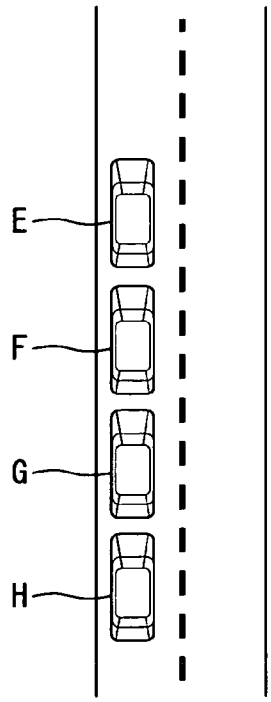
FIG. 7B RELATED ART

A difference between an in-vehicle apparatus 1 of a first embodiment and that of a second embodiment includes the followings: in a second embodiment, an information determination unit 18 performs a transmission cycle adjustment procedure exemplified in FIG. 6 instead of that exemplified in FIG. 3. In the transmission cycle adjustment procedures exemplified in FIGS. 3 and 6, like processes refer to like reference numerals. In the present embodiment, the transmission cycle can vary in a range, for example, between 100 μsec and 2000 μsec.

There will be described below a transmission cycle adjustment procedure exemplified in FIG. 6. After S130, process proceeds to S210. At S210, it is determined whether a same intersection is indicated by the subject vehicle approach intersection information acquired at S110 and the peripheral vehicle approach intersection information acquired at S120, S130. When it is determined at S210 that the same intersection is not indicated, corresponding to NO at S210, process proceeds to S220. At S220, an instruction indicating that the transmission cycle should not be changed is issued and output to the transmission cycle control unit 16. Thus, content of the transmission instruction from the transmission cycle control unit 16 to the packet transmission unit 22 is not changed. That is, the transmission cycle in the packet transmission unit 22 remains a cycle that is determined from the speed of the subject vehicle. After S220, the transmission cycle adjustment procedure is ended.

When it is determined at S210 that the same intersection is indicated, corresponding to YES at S210, process proceeds to S230. At S230, It is determined whether there exists a same directing peripheral vehicle among the peripheral vehicle(s) that satisfies the condition that the subject and peripheral vehicle approach intersection information indicates the same intersection. The same directing peripheral vehicle is a peripheral vehicle that travels in a same orientation and a same direction as the subject vehicle travels.

When it is determined at S230 that the same directing peripheral vehicle does not exist, corresponding to NO at S230, process proceeds to S220. When it is determined at S230 that the same directing peripheral vehicle exists, corresponding to YES at S230, process proceeds to S240.

At S240, the group of vehicles including the subject vehicle and the same directing peripheral vehicle is recognized or set. Then, process proceeds to S250.

At S250 where it is determined whether the subject vehicle is one of a lead vehicle and a tail vehicle in the group recognized or set at S240.

When it is determined at S250 that the subject vehicle is one of the lead vehicle and the tail vehicle in the group recognized at S240, corresponding to YES at S250, process proceeds to S260. At S260, the transmission cycle is set shorter than the predetermined cycle. For example, the transmission cycle may be set to 100 μsec, which is a minimum value in the variable range of the transmission cycle. More specifically, an instruction for setting the transmission cycle to, for example, 100 μsec is issued and output to the transmission cycle control unit 16. The transmission cycle control unit 16 controls the packet transmission unit 22 so that information is transmitted in a cycle with the value (e.g., 100 micron sec) instructed by the information determination unit 18. After S260, the transmission cycle adjustment procedure is ended.

When it is determined at S250 that the subject vehicle is neither the lead vehicle nor the tail vehicle in the group recognized at S240, corresponding to NO at S250, process proceeds to S270. At S260, the transmission cycle is set longer than the predetermined cycle. For example, the transmission cycle may be set to 2000 micron sec, which is a maximum in the variable range of the transmission cycle. More specifically, an instruction for setting the transmission cycle to, for example, 2000 μsec issued and output to the transmission cycle control unit 16. The transmission cycle control unit 16 controls the packet transmission unit 22 so that information is transmitted in a cycle with the value (e.g., 2000 μsec) instructed by the information determination unit 18. After S270, the transmission cycle adjustment procedure is ended.

(Modifications)

The above embodiments can be modified in various ways. For example, a peripheral vehicle that travels in a same direction on a same road as the subject vehicle travels may be recognizance as or set to a member of a group of vehicles that the subject vehicle belongs to. Alternatively, vehicles that are positioned on opposite sides of an insertion one after another may be set to members of a same group in some cases: for example, even if the vehicles are on opposite sides of the intersection, the vehicles may travel in the range of communication with each other, or an inter-vehicular distance may be small. Even in such cases, it is possible to provide the above-described advantages. It becomes possible for a vehicle approaching a group of vehicles to early recognize the presence of the group of vehicles or a representative vehicle of the group. It also becomes possible to suppress a communication traffic increase in a group of vehicles.

In the above embodiments, the transmission cycle depending on the speed of the subject vehicle is calculated with reference to information in the table 15. Alternatively, the transmission cycle may be calculated based on arithmetic computation.

In first and second embodiments and modifications, the packet transmission unit 22 can function as a transmission means or section. The packet reception unit 12 and S120 by the information determination unit 18 can function as a reception means or section. The information determination unit 18 and S170, S180, S195 S200, S260, S270 by the information determination unit 18 can function as a transmission control means or section. Process S110 and S130 by the information determination unit 18 can function as a detection means or section. Process S110 by the information determination unit 18 can function as a subject vehicle approach intersection information acquire means or section of the detection means or section. Process 130 by the information determination unit 18 can function as a peripheral vehicle approach intersection information acquire means or section of the detection means or section. Process S150, S250 by the information determination unit 18 can function as a determination means or section. The transmission cycle control unit 16 can function as a transmission cycle calculation means or section.

The present disclosure includes the following aspects.

According to a first aspect of the disclosure, an inter-vehicle communication apparatus mounted to a subject vehicle is provided. The inter-vehicle communication apparatus includes: a transmission section 22 configured to transmit information about the subject vehicle to a peripheral vehicle existing around the subject vehicle; a reception section 12, S120 configured to receive information about the peripheral vehicle from the peripheral vehicle; and a detection section S110, S130 configured to identify the peripheral vehicle that satisfies a predetermined condition as a same directing peripheral vehicle based on the information about the peripheral vehicle. The predetermined condition includes a first condition that the peripheral vehicle is traveling on a same road and in a same direction as the subject vehicle is traveling. The inter-vehicle communication apparatus further includes a determination section S150, S250 configured to determine whether the subject vehicle is one of a lead vehicle and a tail vehicle in a group of vehicles. The group of vehicles includes the subject vehicle and the same directing peripheral vehicle. The inter-vehicle communication apparatus further includes a transmission control section 16, 18, S170, S180, S195, S200, S260, S270 configured to control the transmission section 22 in such manner that: (i) when the determination section S150, S250 determines that the subject vehicle is one of the lead vehicle and the tail vehicle in the group of vehicles, the transmission control section 16, 18, S170, S180, S195, S200, S260, S270 causes the transmission section 22 to transmit the information about the subject vehicle in a first cycle; and (ii) when the determination section S150, S250 determines that the subject vehicle is neither the lead vehicle nor the tail vehicle in the group of vehicles, the transmission control section 16, 18, S170, S180, S195, S200, S260, S270 causes the transmission section 22 to transmit the information about the subject vehicle in a second cycle. The first cycle is shorter than a predetermined cycle. The second cycle is longer than the predetermined cycle.

According to the above apparatus, the information can be transmitted from the lead vehicle and the tail vehicle of the group of vehicles in a cycle shorter than a predetermined cycle. Thus, it becomes possible to, for example, notify at an early stage a presence of the lead vehicle or the tail vehicle to another vehicle that is approaching the group. Consequently, it becomes possible to notify a presence of the group of vehicles.

According to the above advantage, it is possible to reduce the difficulties described in "Description of Related Art". For example, when multiple vehicles are forming a group while stooping or while traveling at low speeds, it is possible to reduce a risk of collision occurring in a situation where another vehicle approaches the group of vehicles at a high speed from behind the group. This is because the transmission cycle becomes shorter than the predetermined cycle in the tail vehicle of the group, and it becomes therefore possible for the vehicle approaching the group to recognize the tail vehicle and the group of vehicle at an early stage.

Further, according to the above apparatus, vehicles other than the lead and tail vehicles in the group can have the transmission cycle longer than the predetermined period. It is thus possible to restrict a communication traffic increase in the group. Thus, a proper information transmission timing is further ensured in each vehicle in the group. Consequently, it becomes possible to reliably access what peripherical vehicle situations are in.

Accordingly, the above inter-vehicle communication can have a transmission cycle in accordance with not only a subject vehicle situation (e.g., a traveling direction) but also a peripheral vehicle situation (e.g., a traveling direction), and can perform in effective and efficient manners.

According to a second aspect of the disclosure, the above inter-vehicle communication apparatus of the first aspect may further has the following configuration. The detection section S110, S130 includes a subject vehicle approach intersection information acquisition section S110 configured to acquire subject vehicle approach intersection information indicating a subject vehicle approach intersection. The subject vehicle approach intersection is an intersection that is positioned nearest to the subject vehicle among intersections existing in a traveling direction of the subject vehicle. The detection section S110, S130 further includes a peripheral vehicle approach intersection information acquisition section S130 configured to acquire peripheral vehicle approach intersection information indicating a peripheral vehicle approach intersection. The peripheral vehicle approach intersection is an intersection that is positioned nearest to the peripheral vehicle among intersections existing in a traveling direction of the peripheral vehicle. The predetermined condition further includes a second condition that the peripheral vehicle approach intersection is identical to the subject vehicle approach intersection.

That is, the peripheral and subject vehicles that are traveling on a same road, in a same direction and toward a same intersection are recognized as members of a same group of vehicles. In the above, vehicles that are positioned on opposite sides of an insertion one after another may not be recognized as members of a same group.

Since a vehicle spaced more than a predetermined distance away from a group of vehicles is to recognize a presence of the group, the vehicle spaced more than the predetermined distance may not be recognized as a member of the group.

Since a traffic light or a turning vehicle may exist at an intersection, vehicles positioned one after another on opposite sides of an insertion may have a large inter-vehicle distance. Since the above inter-vehicle communication apparatus can be configured such that vehicles positioned on opposite sides of an insertion are not recognized as members of a same group.

According to a third aspect of the disclosure, the above inter-vehicle communication apparatus of the first or second aspects may further include a transmission cycle calculation section 16 configured to calculate a third cycle so that the third cycle becomes shorter as a speed of the subject vehicle is larger. Further, the transmission control section 16, 18, S170, S180, S195, S200, S260, S270 causes the transmission section 22 to transmit the information about the subject vehicle in the third cycle when the determination section S150, S250 determines that the subject vehicle is one of the lead vehicle and the tail vehicle in the group of vehicles, and when the speed of the subject vehicle is larger than a predetermined speed.

A technique for transmitting information in a shorter cycle with increasing speed of a subject vehicle is disclosed in JP-A-2000-90395 and has been specified and standardized. That is, the technique is well known. The above inter-vehicle communication apparatus can provides the above-described advantages while utilizing in part such a known technique or a known inter-vehicle communication apparatus.

Accordingly, since it is possible to utilize in part a known technique or a known inter-vehicle communication apparatus, it becomes possible to improve versatility. For example, since it is possible to utilize in part a known configuration or known software, it becomes possible suppress cost such as research and development expenditure.

According to a fourth aspect of the disclosure, the above inter-vehicle communication apparatus of the third aspect may be configured such that: the transmission control section 16, 18, S170, S180, S195, S200, S260, S270 causes the transmission section 22 to transmit the information about the subject vehicle in the third cycle when the determination section S150, S250 determines that the subject vehicle is neither the lead vehicle nor the tail vehicle in the group of vehicles, and when the speed of the subject vehicle is smaller than or equal to the predetermined speed.

The above inter-vehicle communication apparatus also can provides the above-described advantages while utilizing in part a known technique or a known inter-vehicle communication apparatus. Thus, it becomes possible to improve versatility according to the above-described manners.

According to a fifth aspect of the disclosure, the inter-vehicle communication of the first and second aspects may further includes a transmission cycle calculation section 16 configured to calculate a third cycle so that the third cycle becomes shorter as a speed of the subject vehicle is larger. Further, the transmission control section 16, 18, S170, S180, S195, S200, S260, S270 causes the transmission section 22 to transmit the information about the subject vehicle in the third cycle when the determination section S150, S250 determines that the subject vehicle is neither the lead vehicle nor the tail vehicle in the group of vehicles, and when the speed of the subject vehicle is smaller than or equal to a predetermined speed.

The above inter-vehicle communication apparatus also can provides the above-described advantages while utilizing in part a known technique or a known inter-vehicle communication apparatus. Thus, it becomes possible to improve versatility according to the above-described manners.

While the invention has been described above with reference to various embodiments thereof, it is to be understood that the invention is not limited to the above described embodiments and construction. The invention is intended to cover various modification and equivalent arrangements. In addition, while the various combinations and configurations described above are contemplated as embodying the invention, other combinations and configurations, including more, less or only a single element, are also contemplated as being within the scope of embodiment.

Further, each or any combination of processes, steps, or means explained in the above can be achieved as a software section or unit (e.g., subroutine) and/or a hardware section or unit (e.g., circuit or integrated circuit), including or not including a function of a related device; furthermore, the hardware section or unit can be constructed inside of a microcomputer.

Furthermore, the software section or unit or any combinations of multiple software sections or units can be included in a software program, which can be contained in a computer-readable storage media or can be downloaded and installed in a computer via a communications network.

What is claimed is:

1. An inter-vehicle communication apparatus mounted to a subject vehicle, comprising:

a transmission section configured to transmit information about the subject vehicle to a peripheral vehicle existing around the subject vehicle;

a reception section configured to receive information about the peripheral vehicle from the peripheral vehicle;

a detection section configured to identify the peripheral vehicle that satisfies a predetermined condition as a same directing peripheral vehicle based on the information about the peripheral vehicle, the predetermined condition including a first condition that the peripheral vehicle is traveling on a same road and in a same direction as the subject vehicle is traveling;

a determination section configured to determine whether the subject vehicle is one of a lead vehicle and a tail vehicle in a group of vehicles, the group of vehicles including the subject vehicle and the same directing peripheral vehicle; and a transmission control section configured to control the transmission section in such manner that:

when the determination section determines that the subject vehicle is one of the lead vehicle and the tail vehicle in the group of vehicles, the transmission control section causes the transmission section to transmit the information about the subject vehicle in a first cycle, the first cycle being shorter than a predetermined cycle; and when the determination section determines that the subject vehicle is neither the lead vehicle nor the tail vehicle in the group of vehicles, the transmission control section causes the transmission section to transmit the information about the subject vehicle in a second cycle, the second cycle being longer than the predetermined cycle.

2. The inter-vehicle communication apparatus according to claim 1, wherein the detection section includes:

a subject vehicle approach intersection information acquisition section configured to acquire subject vehicle approach intersection information indicating a subject vehicle approach intersection, the subject vehicle approach intersection being an intersection that is positioned nearest to the subject vehicle among intersections existing in a traveling direction of the subject vehicle; and a peripheral vehicle approach intersection information acquisition section configured to acquire peripheral vehicle approach intersection information indicating a peripheral vehicle approach intersection, the peripheral vehicle approach intersection being an intersection that is positioned nearest to the peripheral vehicle among intersections existing in a traveling direction of the peripheral vehicle; and the predetermined condition further includes a second condition that the peripheral vehicle approach intersection is identical to the subject vehicle approach intersection.

3. The inter-vehicle communication apparatus according to claim 1, further comprising:

a transmission cycle calculation section configured to calculate a third cycle so that the third cycle becomes shorter as a speed of the subject vehicle is larger, wherein:

the transmission control section causes the transmission section to transmit the information about the subject vehicle in the third cycle when the determination section determines that the subject vehicle is one of the lead vehicle and the tail vehicle in the group of vehicles, and when the speed of the subject vehicle is larger than a predetermined speed.

4. The inter-vehicle communication apparatus according to claim 3, wherein:

the transmission control section causes the transmission section to transmit the information about the subject vehicle in the third cycle when the determination section determines that the subject vehicle is neither the lead vehicle nor the tail vehicle in the group of vehicles, and when the speed of the subject vehicle is smaller than or equal to the predetermined speed.

5. The inter-vehicle communication apparatus according to claim 1, further comprising:

a transmission cycle calculation section configured to calculate a third cycle so that the third cycle becomes shorter as a speed of the subject vehicle is larger, wherein:

the transmission control section causes the transmission section to transmit the information about the subject vehicle in the third cycle when the determination section determines that the subject vehicle is neither the lead vehicle nor the tail vehicle in the group of vehicles, and when the speed of the subject vehicle is smaller than or equal to a predetermined speed.

6. The inter-vehicle communication apparatus according to claim 1, wherein:

when the determination section determines that the subject vehicle is the tail vehicle in the group of vehicles, the transmission control section causes the transmission section to transmit the information about the subject vehicle in the first cycle, which is shorter than the second cycle.

7. The inter-vehicle communication apparatus according to claim 1, wherein:

the transmission control section increases transmission cycle of the information about the subject vehicle from the transmission section in response to determining, by the determination section, that the subject vehicle is one of the lead vehicle and the tail vehicle in the group of vehicles; and the transmission control section decreases the transmission cycle of the information about the subject vehicle from the transmission section in response to determining, by the determination section, that the subject vehicle is neither the lead vehicle nor the tail vehicle in the group of vehicles.

8. The inter-vehicle communication apparatus according to claim 1, wherein:

the transmission control section controls transmission cycle of the information about the subject vehicle from the transmission section, such that the transmission cycle varies in a predetermined range.

9. An inter-vehicle communication method for use in an inter-vehicle communication apparatus mounted to a subject vehicle to communicate with a peripheral vehicle existing around the subject vehicle, the method comprising:

transmitting information about the subject vehicle to the peripheral vehicle using a transmission section of the inter-vehicle communication apparatus;

receiving information about the peripheral vehicle from the peripheral vehicle using a receiving section of the inter-vehicle communication apparatus;

identifying the peripheral vehicle that satisfies a predetermined condition as a same directing peripheral vehicle based on the information about the peripheral vehicle using a detection section of the inter-vehicle communication apparatus, the predetermined condition including a first condition that the peripheral vehicle is traveling on a same road and in a same direction as the subject vehicle is traveling;

determining whether the subject vehicle is one of a lead vehicle and a tail vehicle in a group of vehicles using a determining section of the inter-vehicle communication apparatus, the group of vehicle including the subject vehicle and the same directing peripheral vehicle; and controlling the transmission section using a transmission control section of the inter-vehicle communication apparatus, the controlling including:

causing the transmission section to transmit the information about the subject vehicle in a first cycle when it is determined that the subject vehicle is one of the lead vehicle and the tail vehicle in the group of vehicles, the first cycle being shorter than a predetermined cycle; and causing the transmission section to transmit the information about the subject vehicle in a second cycle when it is determined that the subject vehicle is neither the lead vehicle nor the tail vehicle in the group of vehicles, the second cycle being longer than the predetermined cycle.

10. The inter-vehicle communication method according to claim 9, wherein:

the identifying includes:

acquiring subject vehicle approach intersection information indicating a subject vehicle approach intersection using an acquisition section of the inter-vehicle communication apparatus, the subject vehicle approach intersection being an intersection that is positioned nearest to the subject vehicle among intersections existing in a traveling direction of the subject vehicle; and acquiring peripheral vehicle approach intersection information indicating a peripheral vehicle approach intersection using the acquisition section, the peripheral vehicle approach intersection being an intersection that is positioned nearest to the peripheral vehicle among intersections existing in a traveling direction of the peripheral vehicle; and the predetermined condition further includes a second condition that the peripheral vehicle approach intersection is identical to the subject vehicle approach intersection.

11. The inter-vehicle communication method according to claim 9, further comprising:

calculating a third cycle so that the third cycle becomes shorter as a speed of the subject vehicle is larger using a calculation section of the inter-vehicle communication apparatus, wherein:

the controlling of the transmission section further includes:

causing the transmission section to transmit the information about the subject vehicle in the third cycle when it is determined that the subject vehicle is one of the lead vehicle and the tail vehicle in the group of vehicles, and when the speed of the subject vehicle is larger than a predetermined speed.

12. The inter-vehicle communication method according to claim 11, wherein:

the controlling of the transmission section further includes:

causing the transmission section to transmit the information about the subject vehicle in the third cycle when it is determined that the subject vehicle is neither the lead vehicle nor the tail vehicle in the group of vehicles, and when the speed of the subject vehicle is smaller than or equal to the predetermined speed.

13. The inter-vehicle communication method according to claim 9, further comprising:

calculating a third cycle so that the third cycle becomes shorter as a speed of the subject vehicle is larger using a calculation section of the inter-vehicle communication apparatus, wherein:

the controlling of the transmission section further includes:

causing the transmission section to transmit the information about the subject vehicle in the third cycle when it is determined that the subject vehicle is neither the lead vehicle nor the tail vehicle in the group of vehicles, and when the speed of the subject vehicle is smaller than or equal to the predetermined speed.

14. The inter-vehicle communication method according to claim 9, wherein:

controlling the transmission section includes:

causing the transmission section to transmit the information about the subject vehicle in the first cycle when it is determined that the subject vehicle is the tail vehicle in the group of vehicles, the first cycle being shorter than the second cycle.

15. The inter-vehicle communication method according to claim 9, wherein:

controlling the transmission section includes:

increasing transmission cycle of the information about the subject vehicle from the transmission section in response to determining that the subject vehicle is one of the lead vehicle and the tail vehicle in the group of vehicles; and decreasing the transmission cycle of the information about the subject vehicle from the transmission section in response to determining that the subject vehicle is neither the lead vehicle nor the tail vehicle in the group of vehicles.

16. The inter-vehicle communication method according to claim 9, wherein:

controlling the transmission section includes:

controlling transmission cycle of the information about the subject vehicle from the transmission section, such that the transmission cycle varies in a predetermined range.

* * * * *